US005404605A

United States Patent [19]

Samilo

[11] Patent Number: 5,404,605

[45] Date of Patent: Apr. 11, 1995

[54] DYE APPLICATOR

[75] Inventor: John S. Samilo, Ringgold, Ga.

[73] Assignee: Tapistron International, Inc., Ringgold, Ga.

[21] Appl. No.: 228,727

[22] Filed: Apr. 18, 1994

[51] Int. Cl.[6] ..... D06B 1/08

[52] U.S. Cl. ..... 8/151; 15/307; 68/200; 239/533.1; 239/562

[58] Field of Search ..... 8/151; 68/200; 15/307; 239/436, 443, 533.1, 562; 34/487, 629, 638; 118/213, 301, 406

[56] References Cited

U.S. PATENT DOCUMENTS

| | | | |
|---|---|---|---|
| 1,939,578 | 12/1933 | Sullivan . | |
| 2,001,417 | 5/1935 | Gessner | 15/307 X |
| 2,753,181 | 7/1956 | Anander | 15/307 X |
| 2,753,215 | 7/1956 | Barr | 239/562 X |
| 2,792,587 | 5/1957 | Rose | 15/307 |
| 3,145,427 | 8/1964 | Reiterer | 239/562 X |
| 3,779,047 | 12/1973 | Fleissner | 15/307 X |
| 3,922,752 | 12/1975 | Holm | 15/307 |
| 4,118,956 | 10/1978 | Stoyel | 15/307 X |
| 4,218,026 | 8/1980 | Stange . | |
| 4,292,918 | 10/1981 | Davis | 68/202 X |
| 4,301,602 | 11/1981 | Grondin | 15/307 X |
| 4,672,711 | 6/1987 | Mickler | 15/307 X |
| 4,726,520 | 2/1988 | Brown et al. | 239/562 X |

FOREIGN PATENT DOCUMENTS 2309102 9/1973 Germany .

*Primary Examiner*—Philip R. Coe
*Attorney, Agent, or Firm*—Jones & Askew

[57] ABSTRACT

A dye applicator which applies dye to textiles of different widths. The applicator includes an elongate container and sealing ribbon within the elongate container. The sealing ribbon is positioned inside the container along a strip of perforated slots and is attached at both ends to the container. The sealing ribbon works to seal off holes that are not being used during the application of the dye and allows holes that am being used to be opened so that the dye may flow into the textile.

12 Claims, 2 Drawing Sheets

DYE APPLICATOR

FIELD OF THE INVENTION

This invention relates to dye applicators, and more specifically relates to an apparatus for and method of supplying dye to selected portions of a dye applicator.

BACKGROUND OF THE INVENTION

Textiles are usually formed in a neutral color and then dyed into a final color for sale. To dye the fabrics so that the fabrics have a uniform color of the material throughout, it is important to apply the amount of dye needed to dye the textile, but not to saturate the textile with extra dye. Several applicators which can perform this function have been developed for dyeing textiles.

One type of applicator consists of an elongate tube or cylinder having a circular cross-section and including a number of perforations along its top. These perforations are called "perforated slots" in the industry. The dye applicator is designed such that a textile or carpet may run along one side of the elongate cylinder against the perforated slot. The textile is held in position against the slots by way of a backing device, such as a roll, bladder, or any other drawing or tensioning device, to maintain a seal between the textile and the applicator.

The perforated slot applicators generally introduce dye at a uniform pressure into the side of the cylinder opposite the perforated slots. The pressure of the dye is preferably adequate to push the amount of dye through the perforated slots needed to dye the textile, but not saturate the textile with the dye.

The perforated slot applicators usually have a uniform length, such as twelve feet. This length is ideal for a textile specimen which is the entire length of the applicator, or twelve feet wide. Problems occur when the applicator is used to dye a specimen which is narrower than tile length of the applicator, such as a textile which is six feet wide. The textile to be dyed effects a seal on the perforated slots it covers, causing a pressure differential between the covered and uncovered perforated slots. Because the pressure differential between the uncovered perforated slots and the covered perforated slots is so great, tile dye tends to flow out of the uncovered slots, instead of into the textile, and therefore is wasted and can contaminate the surroundings.

One way that this problem has been dealt with in the past is to provide a reciprocating plug within the elongate cylinder. This plug moves along the inside of the cylinder and effects a seal at its location. The dye inlets on one side of the plug are shut off as the plug is moved such that the dye is introduced only into the opposite side of the cylinder. A problem occurs if tile textile is not fed evenly along its length so that the textile moves back and forth along the elongate cylinder. In response to this, sensors have been employed to determine the ends of the textile and adjust the plug to the end. This system may also employ two of the reciprocating plugs, having complex sensors so that the edges of tile fabric may be sensed and the plugs may move accordingly.

As can be understood from the foregoing, such a system is complex and can be expensive. Therefore, there is a need in the art for a simpler, more inexpensive means of supplying dye to specific regions of a cylinder on a dye applicator.

SUMMARY OF THE INVENTION

The present invention solves the above problems by providing a sealing ribbon within the elongate cylinder. The sealing ribbon is positioned inside the cylinder along the strip of perforated slots and is attached at both ends. The sealing ribbon works to seal off holes that are not being used during the application of the dye and allows holes that are being used to be opened so that the dye may flow into the textile.

More particularly described, the present invention provides an apparatus for and method of dyeing a textile. The apparatus includes an elongate container defining an external surface thereon and an internal chamber therein. The elongate container includes a first opening for receiving into the internal chamber dye under pressure and a second opening extending from an inlet at the internal chamber to an outlet at the external surface of the elongate container for releasing the dye from the internal chamber into the textile. A sealing ribbon is fixed to the elongate container and is disposed within the internal chamber of the container. The sealing ribbon has a buoyancy and is configured such that when the internal chamber is charged with dye under pressure, the sealing ribbon is biased away from the inlet of the second opening by the buoyancy of the sealing ribbon when the textile is placed against the outlet of the second opening. The sealing ribbon is biased by the pressure of the dye against the inlet of the second opening when the outlet of the second opening is uncovered.

The sealing ribbon preferably has opposite ends which are fixed to the elongate container within the elongate container and the second opening is preferably positioned between the opposite ends of the sealing ribbon. The sealing ribbon may comprise an elastomer or any other material suitable for the application, and may have a negative buoyancy in the dye.

The elongate container may also have a plurality of second openings, each extending from an inlet at the internal chamber to an outlet at the external surface of the elongate container for releasing the dye from the internal chamber into the textile. If such a plurality of second openings is provided, the sealing ribbon is configured such that when the internal chamber is charged with dye under pressure and the textile is placed against and covers the outlets of a first subset of the second openings and away from the outlets of the second subset such that the second subset of second openings are uncovered, the sealing ribbon is biased away from each of the inlets of the first subset of second openings by the buoyancy of the sealing ribbon and the sealing ribbon is biased against the inlets of the second subset of second openings by the pressure of the dye. The plurality of second openings may include first and second rows of second openings, the second openings of the first row being offset axially along the central axis of the container from the second openings of the second row.

Therefore, it is an object of the present invention to provide an improved dye applicator.

It is a further object of the present invention to provide a dye applicator which maybe used to dye textiles having varying widths without modifying the applicator to accommodate the different widths.

Still another object of the present invention is to provide a dye applicator which can apply dyes responsive to a fabric moving to varied positions along the length of the applicator.

Further objects, features, and advantages of the present invention will become apparent upon reading the following detailed description of a preferred embodiment of the invention, when taken in conjunction with the drawing and appended claims.

DETAILED DESCRIPTION OF THE INVENTION

Figure 2:
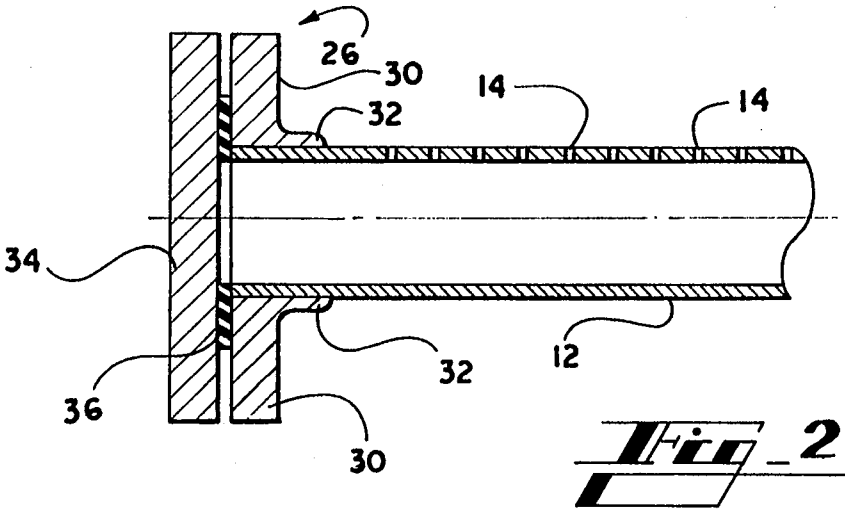
FIG. 2 is a cut-away view elevation of one end of the elongate cylinder of FIG. 1.

Turning now to the drawing, in which like reference numerals are used for like elements throughout the several views, FIGS. 1—4 set forth a dye applicator 10 embodying the present invention. Generally described, the dye applicator 10 includes an elongate container or cylinder 12 having a plurality of openings in the form of perforated slots 14 therealong. Located opposite the perforated slots 14 are a number of openings or inlets 16 for supplying dye to the elongate cylinder 12. The inlets 16 lead from a manifold 18 which is attached via a supply line 20 to a pressurized dye source. The dye applicator 10 is configured such that when the manifold 18 supplies dye to the elongate cylinder 12, a positive pressure of dye is forerod within the elongate cylinder and the dye in turn is forced out of the elongate cylinder through the perforated slots 14 and into a textile 22 traveling along the elongate cylinder.

Figure 1:
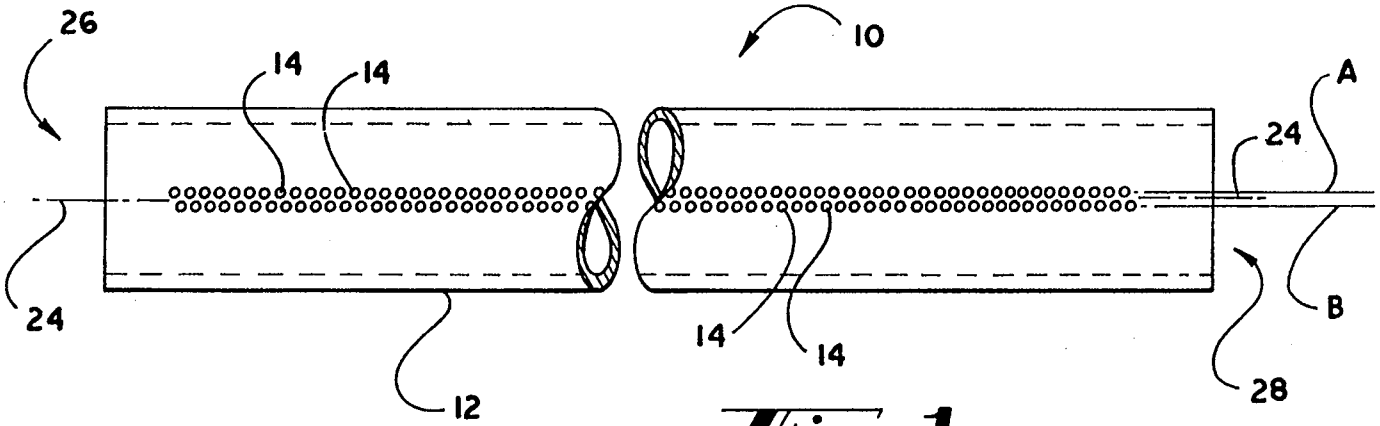
FIG. 1 is a partial plan view of an elongate cylinder used in a dye applicator embodying the present invention.

With reference to FIG. 1, a preferred embodiment of the elongate cylinder 12 is shown. The elongate cylinder 12 defines a central axis 24 therein. The dimensions of the elongate cylinder 12 may vary depending on the application of the dye applicator 10, but the elongate cylinder desirably has a diameter of 3 inches, and a length of 78 inches when used to dye carpet. The elongate cylinder 12 may be standard 3 inch schedule 40 pipe or any other size suitable for the application, and may be made of any suitable material, including, but not limited to PVC or stainless steel.

The dimensions and configuration of the perforated slots 14 may also vary depending on the application of the dye applicator 10, but the perforated slots 14 desirably have a circular cross-section with a diameter of approximately 1/16 inch when the dye applicator is used to dye carpet. Alternatively, the dye applicator may include a continuous elongate slot (not shown) which extends axially the length of the elongate cylinder 12.

As can best be seen in FIG. 1, the perforated slots 14 in the embodiment shown are spaced along two lines A, B, which extend axially along one side of the elongate cylinder 12, such that the central axes for each of the perforated slots 14 lie along either line A or line B. Thus, two rows of perforated slots 14 are formed along the lines A, B. These rows preferably begin approximately 3 inches from ends 26, 28 of the elongate cylinder 12, with the two lines A, B being separated by approximately 0.16 inch.

The perforated slots 14 on each line A, B are arranged such that the central axis of each of the perforated slots is spaced approximately 0.16 inch from the outer circumference of the adjacent perforated slot 14 on the same line A or B. Preferably, the perforated slots 14 of the two lines A, B are axially offset such that a cross-sectional plane of the elongate cylinder 12 which is perpendicular to the central axis 24 of the elongate cylinder includes a central axis of only one of the perforated slots 14 of line A would tall approximately half of the way between two adjacent perforated slots on line B, and vice-versa.

A plurality of inlets 16 are located along a bottom side of the elongate cylinder 12. The inlets 16 lead from a manifold 18 which is attached via supply line 20 to a pressurized dye source. The inlets 16 may be located at any position or in any pattern away from the perforated slots 14 on the elongate cylinder 12, but preferably are spaced axially along the side of the elongate cylinder directly opposite the perforated slots. Although only one inlet 16 is necessary to perform the operation of the invention, a plurality of inlets 16 are preferably spaced along the elongate cylinder 12 so that an even pressure of dye may be applied within the elongate cylinder.

For dyeing carpet, the inlets 16 are preferably spaced approximately 6 inches apart and have an internal diameter of approximately 5/16 of an inch. This internal diameter varies depending upon the application. It has been found that when the inlets 16 having the 5/16 diameter are spaced along the elongate cylinder 12 as described above, that a pressure of 2–3 water column (WC) is sufficient to dye certain textiles such as carpet.

A cross section of one end 26 of the elongate cylinder 12 is displayed in FIG. 2. The ends 26, 28 are identical, and therefore the description with reference to the one end 26 applies to the construction of the other end 28. As can be seen in FIG. 2, a flange 30 having a neck 32 extends around the end 26 of the elongate cylinder 12. A blind 34 extends adjacent to the flange 30 with a gasket 36 extending therebetween. The flange 30 is sealed to the blind 34 with any suitable connection, including, but not limited to glue, screws, nuts and bolts, or any other connectors. If the elongate cylinder 12 is constructed of 3 inch schedule 40 PVC pipe, the flange 30 and the blind 34 may be formed of 3 inch schedule 80 flange and blind and may be sealed by PVC cement. The ends 26, 28 may be formed of any other suitable construction which performs a suitable seal, including but not limited to the use of O-rings, gaskets and other sealing materials.

Figures 3, 4:
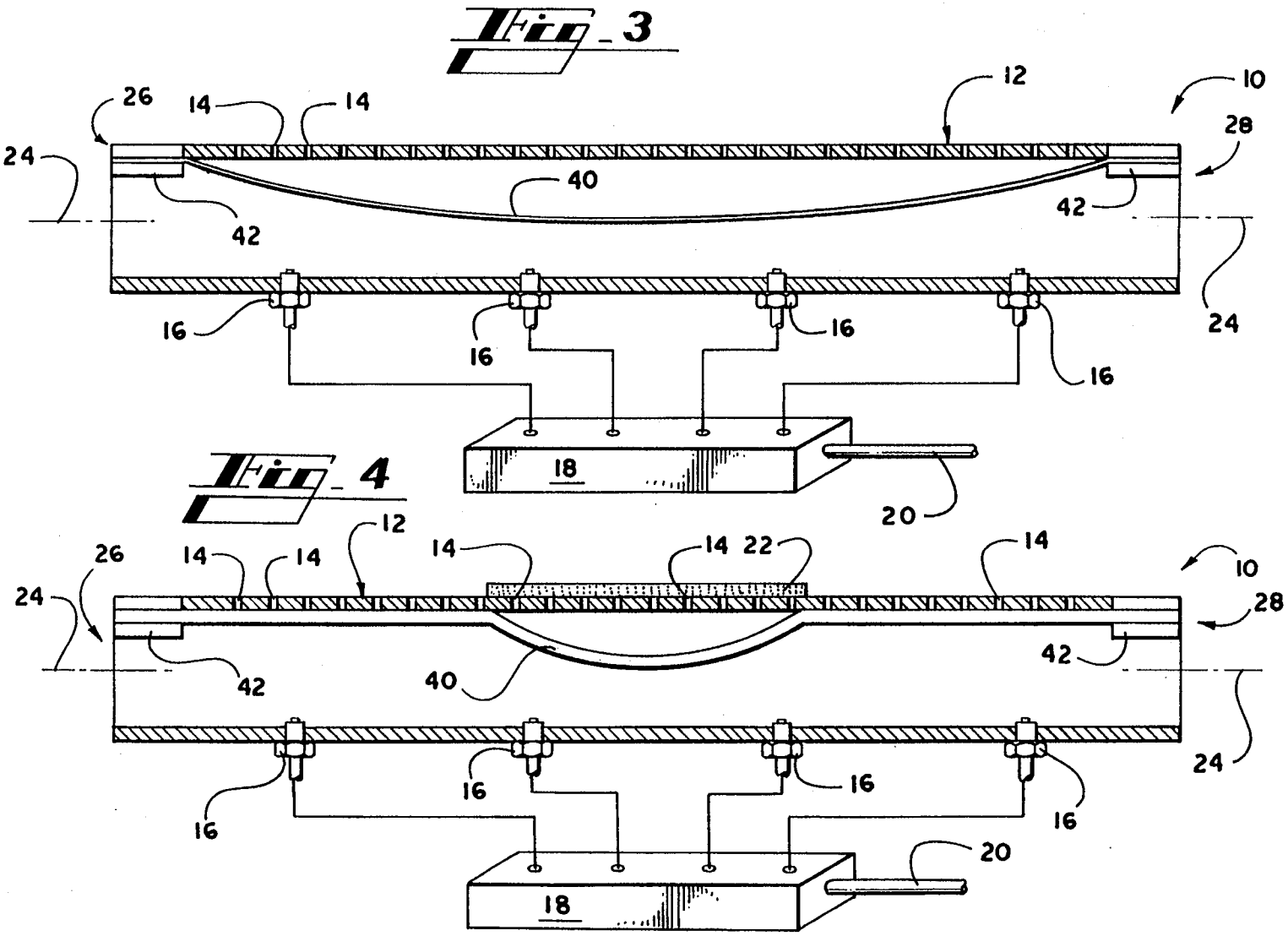
FIG. 3 is a cut-away side elevation view of the cylinder of FIG. 1, taken along line A.
FIG. 4 is a cut-away view, similar to FIG. 3, with a textile in place.

As can best be seen in FIGS. 3 and 4, a sealing ribbon 40 is disposed within the elongate cylinder 12, and is held at opposite ends thereof by connectors 42. The sealing ribbon 40 is positioned along the perforated slots 14 and attached at both ends of the elongate cylinder 12. The sealing ribbon 40 is preferably made of Viton® rubber, but any elastomer suited for the application could be used. Preferably, the sealing ribbon 40 has a buoyancy in the dye which tends to bias it away from the perforated slots 14. In the embodiment shown, the perforated slots are located at the top of the cylinder, therefore, the sealing ribbon 40 preferably has a negative buoyancy.

The sealing ribbon 40 has a width sufficient to extend across the two rows of perforated slots 14 and block the flow of dye therethrough. The sealing ribbon may have any configuration, but preferably is capable of assuming the profile of the interior side, or inlet of the slots. For example, if one elongate, axial slot were provided along the length of the cylinder, the ribbon would preferably have a V-shaped configuration so as to properly close the slot. For the embodiment described herein as being suitable for carpet, the sealing ribbon 40 is preferably a flat, elongate band having dimensions of 1inch wide by 1/16 of an inch thick. As can be seen in FIG. 3, the sealing ribbon 40 is preferably of sufficient length such that when there is no pressurized dye within the elongate cylinder 12, the sealing ribbon hangs freely from the connectors 42, but is spaced apart from the bottom of the elongate cylinder.

The connectors 42 hold the ends of the sealing ribbon 40 firmly against the upper side of the elongate cylinder 12, along both the lines A, B, such that the sealing ribbon hangs directly below the perforated slots 14 when the perforated slots are arranged at the top of the elongate cylinder. The connectors 42 are preferably spaced inward from the beginning of the perforated slots 14. In the embodiment having dimensions such as is set forth above, the connectors 42 are located within 3 inches from the ends 26, 28 of the elongate cylinder 12, such that the sealing ribbon 40 is hanging freely below each of the perforated slots 14 and dye may flow freely through each of the slots when the sealing ribbon 40 is hanging in this manner. The length of sealing ribbon 40 for the embodiment described is preferably 72 11/16 inches. This length is adequate to form a cantenary with the bottommost portion of the cantenary raised above the bottom of the elongate cylinder 12.

During the operation of the dye applicator 10, the supply line 20 offers pressurized dye to the manifold 18, which in tum divides the flow of dye to the inlets 16, fills the elongate cylinder 12 with the dye, and causes dye within the elongate cylinder to be pressurized. A textile 22 is fed along the elongate cylinder 12 at the perforated slots 14 by way of a backing device, such as a roll, a bladder, a drawing or tensioning device, or other backing devices known in the art, such as to maintain a seal between the textile and the upper edge of the elongate cylinder along the perforated slots. The textile 22 has a width which is equal to or less than the length of the perforated slots 14 (72 inches in the embodiment described above). As shown in FIG. 4, the continuous piece of textile 22 feeds out of the page.

As the textile 22 moves along the elongate cylinder 12, the sealing ribbon 40 works to seal off holes that am not being used during the application of dye and allows holes that am being used to be opened so that the dye may flow into the textile. As can be seen in FIG. 4, the sealing ribbon 40 moves upward to cover the perforated slots 14 which are uncovered and hangs down from the holes which are covered by the textile 22.

The sealing ribbon 40 moves responsive to flow rates or possible flow rates of the dye at each of the perforated slots 14. The principal of operation is based on differential pressure. With the elongate cylinder 12 being charged with a positive pressure of dye and no textile 22 present on the elongate cylinder, the change in pressure from the elongate cylinder to atmosphere at the perforated slots 14 is great, setting up a situation where a large amount of dye may flow freely out of the perforated slots 14. The pressure differential and potential strong dye flow causes the sealing ribbon 40 to be drawn or pressed to the perforated slots 14, thereby preventing flow.

When a textile 22 is present over some of the perforated slots 14, a seal is effectively created on the top side, or outer side, of the perforated slots 14 covered by the textile 22. The flow of dye into the textile is essentially minimal, and thus the pressure differential created across the perforated slots 14 is also minimal. The sealing ribbon 40 is thus drawn to that portion of the perforated slots 14 having the highest pressure drop; that is, the uncovered perforated slots where the flow would potentially be strong out of the perforated slots. This pressure differential is adequate to overcome the negative buoyancy of the sealing ribbon 40 and thus the sealing ribbon is pressed into place against the uncovered perforated slots 14. Because the textile 22 effectively forms a seal over the covered perforated slots 14, the flow of the dye into the textile is slow, forming only a slight presstire change across the covered perforated slots 14. This slight pressure change and slow flow rate is insufficient to overcome the negative buoyancy of the sealing ribbon 40; therefore, the sealing ribbon hangs freely below and is spaced from the perforated slots 14.

While this invention has been described in detail with reference to preferred embodiments thereof, it is to be understood that variations and modifications can be made without departing from the spirit and scope of the invention as defined in the following claims. For example, although specific dimensions am given for the elongate cylinder 12, the perforated slots 14, and the other elements of the dye applicator 10, the dimensions given describe a dye applicator which has been found to work well with particular textiles such as carpet having a width of 6 feet or less, and it is to be understood that the dye applicator may have any dimensions to satisfy a particular application. In addition, although the perforated slots 14 have been described as aligned across the top of the elongate cylinder 12, it is to be understood that various orientations of the perforated slots relative to the elongate cylinder are available, depending upon, among other factors, the buoyancy of the sealing ribbon 40, and the pressure of the dye.

What is claimed is:

1. A dye applicator for dyeing a textile, comprising:

an elongate container defining an external surface thereon and an internal chamber therein, the elongate container having a first opening for receiving into the internal chamber dye under pressure and a second opening in the container extending from an inlet at the internal chamber to an outlet at the external surface of the elongate container for releasing the dye from the internal chamber into the textile; and a sealing ribbon fixed to the elongate container and disposed within the internal chamber of the container, the sealing ribbon having a buoyancy and being configured such that when the internal chamber is charged with dye under pressure, (1) the sealing ribbon is biased away from the inlet of the second opening by the buoyancy of the sealing ribbon when the textile is placed against the outlet of the second opening, and (2) the sealing ribbon is biased by the pressure of the dye against the inlet of the second opening when the outlet of the second opening is uncovered.

2. A dye applicator as in claim 1, wherein the sealing ribbon has opposite ends which are fixed to the elongate container within the elongate container and the second opening is positioned between the opposite ends of the sealing ribbon.

3. A dye applicator of claim 1, wherein the sealing ribbon comprises an elastomer.

4. A dye applicator as in claim 1, wherein the sealing ribbon has a negative buoyancy in the dye.

5. A dye applicator as in claim 1, the elongate container further having a plurality of second openings, each extending from an inlet at the internal chamber to an outlet at the external surface of the elongate container for releasing the dye from the internal chamber into the textile, the sealing ribbon being configured such that when the internal chamber is charged with dye under pressure and the textile is placed against and covers the outlets of a first subset of the second openings and away from the outlets of a second subset such that the second subset of second openings are uncovered, the sealing ribbon is biased away from each of the inlets of the first subset of second openings by the buoyancy of the sealing ribbon and the sealing ribbon is biased against the inlets of the second subset of second openings by the pressure of the dye.

6. A dye applicator as in claim 5, wherein the sealing ribbon has opposite ends which are fixed to the elongate container within the elongate container and the second openings are positioned between the opposite ends of the sealing ribbon.

7. A dye applicator as in claim 5, wherein the container defines a central axis, the plurality of second openings comprise first and second rows of second openings, the second openings of the first row being offset axially along the central axis of the container from the second openings of the second row.

8. A dye applicator as in claim 1, wherein the elongate container is a cylinder.

9. A dye applicator as in claim 1, wherein the pressurized dye is supplied to the container at a plurality of first openings.

10. A dye applicator as in claim 9, wherein the container defines a central axis, and wherein the plurality of first openings are spaced axially along the central axis.

11. A dye applicator as in claim 10, the elongate container further having a plurality of second openings, each extending from an inlet at the internal chamber to an outlet at the external surface of the elongate container for releasing the dye from the internal chamber into the textile, the sealing ribbon being configured such that when the internal chamber is charged with dye under pressure and the textile is placed against and covers the outlets of a first subset of the second openings and away from the outlets of a second subset such that the second subset of second openings are uncovered, the sealing ribbon is biased away from each of the inlets of the first subset of second openings by the buoyancy of the sealing ribbon and the sealing ribbon is biased against the inlets of the second subset of second openings by the pressure of the dye.

12. A method of applying dye to a textile comprising the steps of:

providing an applicator, the applicator comprising:

an elongate container defining an external surface thereon and an internal chamber therein, the elongate container having a first opening for receiving into the internal chamber dye under pressure and a second opening in the container extending from an inlet at the internal chamber to an outlet at the external surface of the elongate container for releasing the dye from the internal chamber into the textile; and a sealing ribbon fixed to the elongate container and disposed within the internal chamber of the container;

charging the container through the first opening with a positive pressure of dye; and periodically passing the textile against the outlet of the second opening;

the sealing ribbon having a buoyancy and being configured such that when the internal chamber is charged with dye under pressure, (1) the sealing ribbon is biased away from the inlet of the second opening by the buoyancy of the sealing ribbon when the textile is placed against the outlet of the second opening, and (2) the sealing ribbon is biased by the pressure of the dye against the inlet of the second opening when the outlet of the second opening is uncovered.

* * * * *